US011208296B2

(12) United States Patent
Christen et al.

(10) Patent No.: US 11,208,296 B2
(45) Date of Patent: Dec. 28, 2021

(54) METHOD FOR CONSTRUCTING AN ELEVATOR SYSTEM HAVING INCREASING USABLE LIFTING HEIGHT

(71) Applicant: Inventio AG, Hergiswil (CH)

(72) Inventors: Lukas Christen, Kilchberg (CH); Pascal Bläsi, Dierikon (CH); Stefan Weber, Niederwil (CH); Gabriele Bizzozero, Root (CH)

(73) Assignee: INVENTIO AG, Hergiswil (CH)

( * ) Notice: Subject to any disclaimer, the term of this patent is extended or adjusted under 35 U.S.C. 154(b) by 56 days.

(21) Appl. No.: 16/649,740

(22) PCT Filed: Sep. 19, 2018

(86) PCT No.: PCT/EP2018/075347
§ 371 (c)(1),
(2) Date: Mar. 23, 2020

(87) PCT Pub. No.: WO2019/068469
PCT Pub. Date: Apr. 11, 2019

(65) Prior Publication Data

US 2020/0277158 A1 Sep. 3, 2020

(30) Foreign Application Priority Data

Oct. 6, 2017 (EP) ..... 17195263

(51) Int. Cl.
*B66B 5/00* (2006.01)
*B66B 5/28* (2006.01)
*B66B 19/00* (2006.01)

(52) U.S. Cl.
CPC ..... *B66B 5/005* (2013.01); *B66B 5/284* (2013.01); *B66B 19/002* (2013.01)

(58) Field of Classification Search
CPC ..... B66B 5/005; B66B 5/284; B66B 19/002; B66B 19/007; B66B 9/187
See application file for complete search history.

(56) References Cited

U.S. PATENT DOCUMENTS 3,851,736 A * 12/1974 Westlake ..... B66B 19/002 52/745.2
5,033,586 A * 7/1991 Richards ..... B66B 9/187 187/259

(Continued)

FOREIGN PATENT DOCUMENTS

WO 2011048275 A1 4/2011
WO 2015003965 A1 1/2015

*Primary Examiner* — Michael A Riegelman
(74) *Attorney, Agent, or Firm* — William J. Clemens; Shumaker, Loop & Kendrick, LLP

(57) ABSTRACT

A method for constructing at least two elevators in a building under construction adapts the usable lifting heights of the elevators to an increasing height of the building, wherein each of the elevators is arranged in an elevator shaft of the building associated with the elevator and includes a drive platform having an elevator drive machine that supports and drives an elevator car and a counterweight by a traction sheave and at least one flexible suspension device. In order to adapt the usable lifting heights, lifting operations are performed in which in alternation one of the drive platforms is raised to a higher level in the associated elevator shaft and is locked there. A single lifting platform is temporarily fastened above the particular drive platform to be lifted to apply a lifting force required to raise the drive platform, which force is transferred to supporting elements of the elevator shaft.

19 Claims, 6 Drawing Sheets

(56) References Cited

U.S. PATENT DOCUMENTS 7,635,049 B2 * 12/2009 Van Der Meijden ..... B66B 19/002 187/401
10,501,289 B2 * 12/2019 Rasanen ..... B66B 19/005
2010/0018809 A1 1/2010 Peacock et al.
2010/0133048 A1 * 6/2010 Eman ..... B66B 19/00 187/414
2011/0113720 A1 * 5/2011 Peacock ..... B66B 19/00 52/741.1
2012/0291395 A1 * 11/2012 Plathin ..... B66B 19/02 52/741.1
2013/0233655 A1 * 9/2013 Peacock ..... B66B 20/00 187/414
2013/0284543 A1 * 10/2013 De Jong ..... B66B 11/00 187/249
2014/0000987 A1 * 1/2014 Peacock ..... B66B 19/007 187/414
2014/0231179 A1 * 8/2014 Alasentie ..... B66B 7/062 187/251
2015/0307322 A1 * 10/2015 Peacock ..... B66B 7/064 187/254
2016/0152442 A1 * 6/2016 Weber ..... B66B 19/005 187/359
2018/0186607 A1 * 7/2018 Ratia ..... B66B 19/00
2018/0273349 A1 * 9/2018 Weibel ..... B66B 19/00
2018/0290863 A1 * 10/2018 Peacock ..... B66B 11/0045
2019/0193995 A1 * 6/2019 Christen ..... B66B 11/0005
2019/0276277 A1 * 9/2019 Christen ..... B66B 19/00
2019/0322491 A1 * 10/2019 Christen ..... B66B 19/00
2019/0330022 A1 * 10/2019 Christen ..... B66B 9/00
2020/0062549 A1 * 2/2020 Kim ..... B66B 11/0045
2020/0180912 A1 * 6/2020 Li ..... B66B 19/00
2020/0277158 A1 * 9/2020 Christen ..... B66B 19/00
2021/0206602 A1 * 7/2021 Studer ..... B66B 9/02

* cited by examiner

METHOD FOR CONSTRUCTING AN ELEVATOR SYSTEM HAVING INCREASING USABLE LIFTING HEIGHT

FIELD

The present invention relates to a method for constructing at least two elevators in a building under construction, wherein the usable lifting heights of said elevators are adapted incrementally to an increasing height of the building.

BACKGROUND

Instead of starting with the installation of said elevators only when the building under construction allows for the installation of the elevators at their final lifting heights, the elevators are already being installed during an earlier construction phase as soon as several floors of the building and the required elevator shafts with a corresponding height are created. The usable lifting heights of such elevators are adaptable in the course of the construction of the building to its current building height, and so the elevators grow along with the building and can already be used during the construction of the building for the vertical transport of people or material. As a result, elevators provided especially for transport tasks during the construction phase—for example, those which are attached to the outside of the building—can be completely or partially foregone.

WO2011048275A1 discloses such an elevator installation method, in which an elevator with one elevator drive machine, one elevator car, and one counterweight is mounted in a designated elevator shaft as soon as several lower floors of the building and an elevator shaft associated with the elevator are constructed with a corresponding height. The elevator car and the counterweight of the elevator are suspended on a drive platform which comprises the elevator drive machine, wherein at least one suspension means is guided from the elevator car to the counterweight via at least one traction sheave of the drive machine, and wherein the drive platform is raised by means of a lifting device to a next higher level when the current building height makes an enlargement of the usable lifting heights of the elevator systems appear appropriate. From an assembly platform, the guide rails of the elevator system are successively mounted in the elevator shaft during the construction phase, and so the drive platform can be raised along these guide rails in the elevator shaft in order to adapt the usable lifting height of the elevator. The drive platform can then be supported at a desired higher level by means of support beams extendable from the drive platform on supporting elements of the elevator shaft.

In order to raise the drive platform, a lifting platform is used which, prior to the raising of the drive platform, is fastened as far as possible above the drive platform in the elevator shaft. The lifting platform is equipped with deflection rollers, over which traction means of a hoist mounted on the drive platform are guided. By means of said hoist, the drive platform together with at least the elevator car in the elevator shaft is raised to a new level adapted to the current building height and supported there. In the final state of the elevator system, the drive platform is used as the machine room floor of the completed elevator system.

However, WO2011048275A1 does not indicate any possibility for realizing simplifications or cost reductions in elevator systems, in which a plurality of elevators is installed in the same building with a usable lifting height which can be adapted to an increasing height of the building.

From US20100018809A1, an elevator arrangement and a safety structure and methods for an elevator assembly are known, which relate mainly to the use and securing of at least one so-called working platform. According to one embodiment, the working platform is used for installing elevators, which are arranged in adjacent elevator shafts of a building under construction. Each of the elevators comprises a drive platform, having a drive machine which supports and drives the elevator car. In order to adapt the usable lifting heights of the elevators to an increasing height of the building, the assembly platforms, among others, are raised in the respectively associated elevator shaft.

SUMMARY

The present invention addresses the problem of providing a cost-saving method for constructing elevator systems which comprise a plurality of elevators, the usable lifting height of which is adaptable to an increasing building height during the construction phase.

The problem is solved by a method for constructing at least two elevators in a building under construction, wherein the usable lifting heights of said elevators are adapted incrementally to an increasing height of the building, wherein each of the at least two elevators is arranged in an elevator shaft of the building associated with the elevator and comprises a drive platform having an elevator drive machine, which elevator drive machine supports and drives an elevator car and a counterweight by means of a traction sheave and at least one flexible suspension means, wherein, in order to adapt the usable lifting heights, lifting operations are performed, in which in alternation one of the drive platforms of the at least two elevators is raised to a higher level in the associated elevator shaft and is locked there, and wherein, in order to perform said lifting operations, a single lifting platform is used, which is temporarily fastened above the particular drive platform to be lifted, in the elevator shaft associated with the particular drive platform, and forms a supporting construction, by means of which the lifting force required to raise the drive platform is transferred to supporting elements of the elevator shaft.

The invention is therefore based on the idea of foregoing the provision of a plurality of lifting platforms in an elevator system with a plurality of elevators, the usable lifting heights of which are adjusted by incrementally raising the drive platform, in that a single lifting platform is moved in each case to a position above the respective drive platform to be lifted—or above the elevator shaft associated with said drive platform. Such a transfer of the lifting platform can take place before or after the lifting platform is raised to a new, higher building level. Since a very stable lifting platform with an adjustable support device and at least one drive platform hoist is required for raising a drive platform with elevator car, counterweight and elevator suspension means, the method according to the invention or the elevator system according to the invention have the advantage that considerable cost savings can be realized with their application.

In the present document, the term "elevator shaft" is supposed to refer to a space in a building under construction, the height of which increases according to the construction progress, wherein the space is dimensioned and configured such that an elevator car and a counterweight of one elevator each can move up and down along vertical tracks in said space. Such an elevator shaft can be a single shaft enclosed by shaft walls. However, it can also be part of a continuous space, and in said part, the tracks of an elevator car and a counterweight of each one of the at least two mutually parallel elevators are arranged, wherein there is no shaft wall between the tracks of adjacent elevators but usually steel beams for attaching elevator components.

In the present document, the term "traction means" refers to any elongated and non-rigid component, for example, wire ropes, belts, or chains, suitable for transmitting tensile forces.

In the following, the term "transfer" refers to a transport of a lifting platform from an elevator shaft delivering the lifting platform to an elevator shaft receiving the lifting platform, said transport usually comprising a raising in the delivering elevator shaft, a sideways movement between both elevator shafts, and a lowering or raising in the receiving elevator shaft.

According to an advantageous embodiment of the invention, a drive platform hoist with a drive platform traction means is installed on the lifting platform for raising the drive platforms, wherein, for performing a lifting operation, the drive platform traction means is coupled to the respective drive platform to be lifted. The arrangement of the drive platform hoist on the single lifting platform has the advantage that only a single drive platform hoist is required for raising the drive platforms of at least two elevators.

In a further possible embodiment of the invention, one drive platform hoist with a drive platform traction means is installed on each of the drive platforms for raising the drive platforms, wherein, for performing a lifting operation, the drive platform traction means of the drive platform hoist of the drive platform to be lifted is coupled to the lifting platform positioned above said drive platform.

This embodiment has the advantage that the single lifting platform to be temporarily fastened in the elevator shaft above the particular drive platform to be lifted becomes lighter overall and thus easier to move.

In a further possible embodiment of the invention, a transfer of the lifting platform between the elevator shafts of the at least two elevators concerned is performed for alternately raising the at least two drive platforms in that the lifting platform is suspended on a first lifting platform traction means driven by a first lifting platform hoist and on a second lifting platform traction means driven by a second lifting platform hoist, and the transfer of the lifting platform is effected by a coordinated actuation of the two lifting platform hoists.

This embodiment has the advantage that the transfer of the lifting platform can be realized in a particularly simple and cost-effective manner because wire rope hoists usable as lifting platform hoists are usually used in elevator assemblies, and no additional auxiliary devices, such as horizontal guides, need to be mounted.

In a further possible embodiment of the invention, the first lifting platform traction means, for performing the transfer of the lifting platform, is guided via a first deflection body arranged approximately above the center of gravity of the lifting platform from a first lifting platform hoist mounted on the lifting platform to a first suspension point which, above the lifting platform approximately in the cross-sectional center of the elevator shaft delivering the lifting platform, is supported by said elevator shaft, and the second lifting platform traction means is guided via a second deflection body arranged approximately above the center of gravity of the lifting platform from the second lifting platform hoist also mounted on the lifting platform to a second suspension point which, above the lifting platform approximately in the cross-sectional center of the elevator shaft receiving the lifting platform, is supported by said elevator shaft.

With this arrangement of the lifting platform traction means, the transfer of the lifting platform from a position above the elevator shaft delivering the lifting platform to a position above the elevator shaft receiving the lifting platform can be realized in a simple manner.

In a further possible embodiment of the invention, the first lifting platform traction means is fastened to the first suspension point and the second lifting platform traction means is fastened to the second suspension point, or the first lifting platform traction means is guided over a first lifting platform traction means deflection roller arranged on the first suspension point, and the second lifting platform traction means is guided over a second lifting platform traction means deflection roller arranged on the second suspension point, back to the lifting platform and is fastened there.

These two variations of the arrangement of the lifting platform traction means, which form either a 1:1 suspension or a 2:1 suspension of the lifting platform, allow either a slightly faster transfer of a relatively light lifting platform or a slightly slower transfer of a relatively heavy lifting platform.

In a further possible embodiment of the invention, for transferring the lifting platform from the elevator shaft delivering the lifting platform to the elevator shaft receiving the lifting platform, the lifting platform, in a first step, is raised from its support points by retracting the first lifting platform traction means into the first lifting platform hoist, and in a second step, the lifting platform is pivoted about the first suspension point as a pivot center approximately into the cross-sectional center of the elevator shaft receiving the lifting platform by retracting the second lifting platform traction means into the second lifting platform hoist, and in a third step, the lifting platform is moved to its intended vertical position in the elevator shaft receiving the lifting platform by retracting or extending at least the second lifting platform traction means into or from the second lifting platform hoist.

This sequence of the transfer of the lifting platform performed by means of the two lifting platform hoists is particularly simple and requires relatively little time.

In a further possible embodiment of the invention, for transferring the lifting platform from the elevator shaft delivering the lifting platform to the elevator shaft receiving the lifting platform, the lifting platform, in a first step, is raised vertically by retracting the first lifting platform traction means into the first lifting platform hoist, wherein or after which, the second lifting platform traction means is essentially kept taut or is tightened by retracting into the second lifting platform hoist, and in a second step, the lifting platform is pivoted about the second suspension point as a pivot center approximately into the cross-sectional center of the elevator shaft receiving the lifting platform by extending the first lifting platform traction means from the first lifting platform hoist, and in a third step, the lifting platform is moved to its intended vertical position in the elevator shaft receiving the lifting platform by retracting or extending at least the second lifting platform traction means into or from the second lifting platform hoist.

In another possible embodiment of the invention, for transferring the lifting platform from the elevator shaft delivering the lifting platform to the elevator shaft receiving the lifting platform, the lifting platform, in a first step, is raised vertically by retracting the first lifting platform traction means into the first lifting platform hoist. In a second step, the lifting platform is pivoted about the first suspension point as a pivot center approximately to the middle between said elevator shafts by retracting the second lifting platform traction means into the second lifting platform hoist. In a third step, the lifting platform is pivoted about the second suspension point as a pivot center approximately into the cross-sectional center of the elevator shaft receiving the lifting platform by extending the first lifting platform traction means from the first lifting platform hoist, and in a fourth step, the lifting platform is moved to its intended vertical position in the elevator shaft receiving the lifting platform by retracting or extending at least the second lifting platform traction means into or from the second lifting platform hoist. This sequence of the transfer of the lifting platform performed by means of the two lifting platform hoists results in a sideways movement with significantly fewer vertical components, and the transfer can be performed with shorter lifting platform traction means.

In a further possible embodiment of the invention, the two lifting platform hoists are actuated several times alternately during the sideways movement of the lifting platform, which forms part of the transfer, in order to affect an approximately straight-line sideways movement of the lifting platform.

In a further possible embodiment of the invention, the suspension points, at which the first and second lifting platform traction means are fastened or deflected, are arranged on at least one protective platform which is installed in a vertically moveable manner in and supported by the region of the upper ends of the at least two elevator shafts which move upwards during the construction phase. This mounting of the suspension points of the lifting platform traction means in the region of at the least two elevator shafts is advantageous because it can be realized with little effort and because during the installation of elevators, the usable lifting heights of which are adapted incrementally to an increasing height of the building, such protection platforms must in any case necessarily be present in each of the elevator shafts.

In a further possible embodiment of the invention, at least one securing traction means is mounted as fall protection for the lifting platform during the transfer process, which is fastened to the lifting platform, guided from the lifting platform to a securing traction means deflection roller fastened in the region of one of the suspension points for the lifting platform traction means, and subsequently guided back to the lifting platform and through a traction means safety catch attached to the lifting platform, said traction means safety catch blocking the securing traction means and thus a lowering of the lifting platform when a speed, at which the securing traction means moves through the safety catch, exceeds a specific limit.

With such a fall protection, the risk of personal injuries and material damage during the transfer of the lifting platform can be significantly reduced, wherein the possibly occurring load on the traction means and the traction means safety catch is advantageously halved thanks to the guiding of the securing traction means over a securing traction means deflection roller.

In a further possible embodiment of the invention, prior to performing one of the lifting operations, in which one of the drive platforms of the at least two elevators is alternately raised to a higher level, a corresponding raising of the lifting platform within one of the at least two elevator shafts is performed by at least one of the lifting platform hoists with the associated lifting platform traction means guided to a suspension point. This ensures that a sufficient distance is present between the lifting platform and the drive platform to be lifted in order to be able to realize the lifting operation, in which the drive platform is raised by a predetermined lifting distance.

In a further possible embodiment of the invention, at least one shock-absorbing element in the form of an elastic roller or an elastic buffer is mounted on the side of the lifting platform.

This prevents that, in case of a sideways movement or a raising of the lifting platform, a collision of the lifting platform with elements of an elevator shaft leads to damage.

In a further possible embodiment of the invention, for the alternate raising of the at least two drive platforms, the lifting platform is transferred from one of the at least two elevator shafts to another of the at least two elevator shafts, wherein the lifting platform is moved along an essentially horizontally arranged track installed temporarily for such a transfer.

Such a transfer requires some extra effort for the installation of the horizontally arranged track, but it is a suitable alternative method for a situation, in which the method of a transfer with a sideways movement by pivoting the lifting platform on vertically arranged lifting platform traction means cannot be performed.

In another possible embodiment of the invention, the drive platform hoist installed on the lifting platform or a lifting platform hoist used for raising the lifting platform is used as the drive for the sideways movement of the lifting platform along the horizontally arranged track, wherein the traction means of the drive platform hoist or the lifting platform hoist is arranged such that it extends essentially horizontally from the respective hoist to a fastening point present in the region of the elevator shaft receiving the lifting platform.

When using the lifting platform hoist, the lifting platform would have to be coupled to a moving mechanism after the lifting platform is raised in order to be able to free the lifting platform traction means for the sideways movement. This embodiment has the advantage that the sideways movement of the lifting platform along a horizontally arranged track requires no additional drive device.

In the following, embodiments of the invention are described using the attached drawings. Identically acting components are denoted in all drawings with the same reference signs.

DETAILED DESCRIPTION

Figure 1:
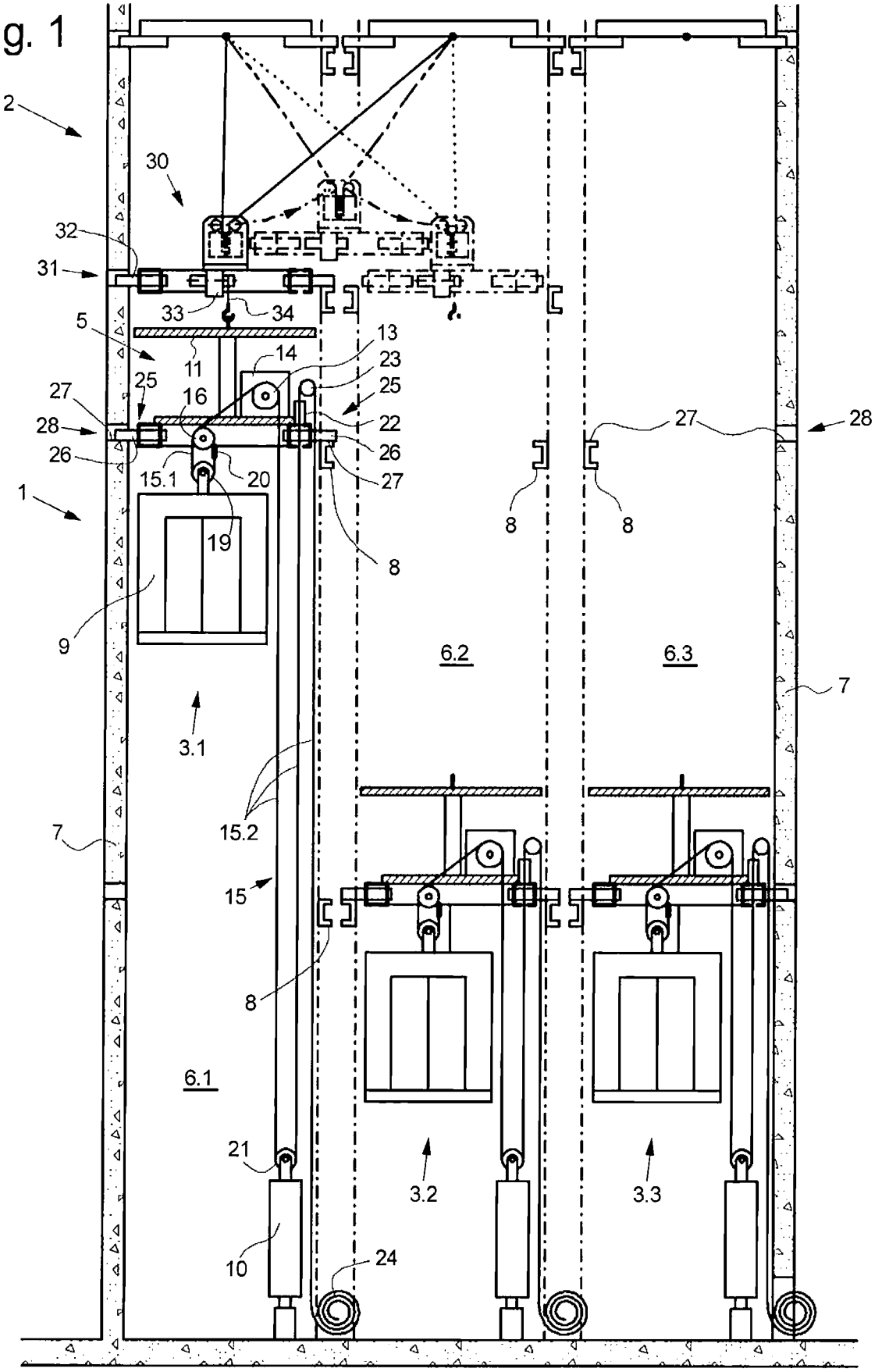
FIG. 1 shows an elevator system suitable for application of the method according to the invention with three elevators adaptable to an increasing building height.

FIG. 1 shows a schematic outline of an elevator system 1 which comprises three elevators 3.1, 3.2, 3.3 arranged in a row next to one another in a building 2. The building 2 is under construction, and the three elevators 3.1, 3.2, 3.3 are designed such that their usable lifting heights can be adapted to an increasing height of the building 2 in that a respective drive platform associated with one of the elevators and forming a temporary machine room 5 is designed to be raiseable. Each of the three elevators 3.1, 3.2, 3.3 is arranged in an associated elevator shaft 6.1, 6.2, 6.3. Each of the elevator shafts 6.1, 6.2, 6.3 can be enclosed by four vertical shaft walls 7, or it can be part of a common shaft space, wherein the elevator shafts 6.1, 6.2, 6.3 are usually separated from one another by steel beams 8, at which at least guide rails for elevator cars 9 and counterweights 10 are attached. A situation is shown, in which the drive platforms 5 of two of the three elevators 3.1, 3.2, 3.3 are still positioned at a lower level which corresponds to an earlier building height, and in which the drive platform 5 of the third elevator has already been raised to a higher level adapted to the current building height and locked there.

Each of the three elevators 3.1, 3.2, 3.3 comprises a drive platform 5 which is vertically moveable along the associated elevator shaft 6.1, 6.2, 6.3 and provided with a protective roof 11, and which serves as support for an elevator drive machine 14 provided with a traction sheave 13. Each of the elevators 3.1, 3.2, 3.3 further comprises an elevator car 9 and a counterweight 10, which are supported by the elevator drive machine 14 via the traction sheave 13 and at least one suspension means 15 and driven along guide rails (not depicted). A first run 15.1 of the suspension means 15 is guided from the traction sheave 13 of the elevator drive machine 14 via a deflecting roller 16 arranged on the drive platform 5 to a car support roller 19 on the elevator car 9 and subsequently to a first fixed point 20 on the drive platform 5, and a second run 15.2 of the suspension means 15 is guided from the traction sheave 13 to a counterweight support roller 21 on the counterweight 10 and subsequently to a second fixed point 22 on the drive platform 5. After the second fixed point 22, which is designed as a detachable suspension means clamp, the second run 15.2 of the suspension means 15 is guided around a deflection roller 23 arranged on the drive platform 5 and subsequently downwards to a suspension means storage 24. For adapting the usable lifting height of an elevator to an increasing height of the building 2, i.e., when the drive platform 5 is raised, the additionally required quantity of suspension means can be supplied from said suspension means storage 24, wherein, prior to the raising of the drive platform, the elevator car 9 is coupled to the drive platform, the counterweight 10 is supported in the region of the lower end of the elevator shaft, and the suspension means clamp forming the second fixing point 22 is released. In order to be able to raise and lock the drive platforms 5 of the three elevators 3.1, 3.2, 3.3 again at higher levels in their elevator shafts 6.1, 6.2, 6.3, each of the three drive platforms 5 comprises supporting devices 25 with retractable and extendable support beams 26, said supporting devices being used to support the drive platforms on support points 27. Such support points are formed, for example, by shaft wall recesses 28 or by steel beams 8 arranged between the elevator shafts.

For performing the lifting operations, in which one of the drive platforms 5 of the three elevators is alternately raised to a higher level along their respective elevator shaft 6 and locked there, a single lifting platform 30 is used, which is temporarily fastened in the elevator shaft above the respective drive platform 5 to be lifted. For fastening or locking the lifting platform 30 in one of the elevator shafts 6.1, 6.2, 6.3, the lifting platform 30 in the present example is also equipped with supporting devices 31 which comprise retractable and extendable support beams 32. By means of said supporting devices 31, the lifting platform 30 can also be supported by the supporting points 27 which are formed by shaft wall recesses 28 or by steel beams 8 arranged in the elevator shafts. The lifting platform 30 forms a sufficiently stable supporting construction, by means of which the lifting force required for lifting the drive platform 5, which usually weighs several thousand kilograms, can be transmitted to supporting points 27 formed by supporting elements of the elevator shaft 6.

Advantageously, a drive platform hoist 33 with a drive platform traction means 34 is installed on the lifting platform 30, wherein, for performing a lifting operation, in which the associated drive platform is raised, the drive platform traction means 34 is coupled to the respective drive platform 5 to be lifted.

In an alternative embodiment of the installation method, a drive platform hoist 33 with a drive platform traction means 34 can be mounted on each of the drive platforms 5, wherein, for raising one of the drive platforms, the drive platform traction means of the drive platform hoist of the drive platform to be lifted is coupled to the respective lifting platform positioned above said drive platform. This embodiment is shown in FIG. 2 and described in connection with FIG. 2.

In order to be able to perform the lifting operations for raising the drive platforms 5 required for all three elevators 3.1, 3.2, 3.3 for adapting to a current building height, the only lifting platform 30—as shown in FIG. 1—is transferred from the elevator shaft delivering the lifting platform to the elevator shaft receiving the lifting platform by at least one sideways movement. There, the lifting platform 30 is either supported by the elevator shaft at the previous level above the drive platform 5 present in the receiving elevator shaft or raised to a new level adapted to the current building height and supported there. The devices required for the lifting and the sideways movement of the lifting platform as well as different embodiments of the transfer or the sideways movement shall be described in more detail below using FIGS. 2 to 6.

Figure 2:
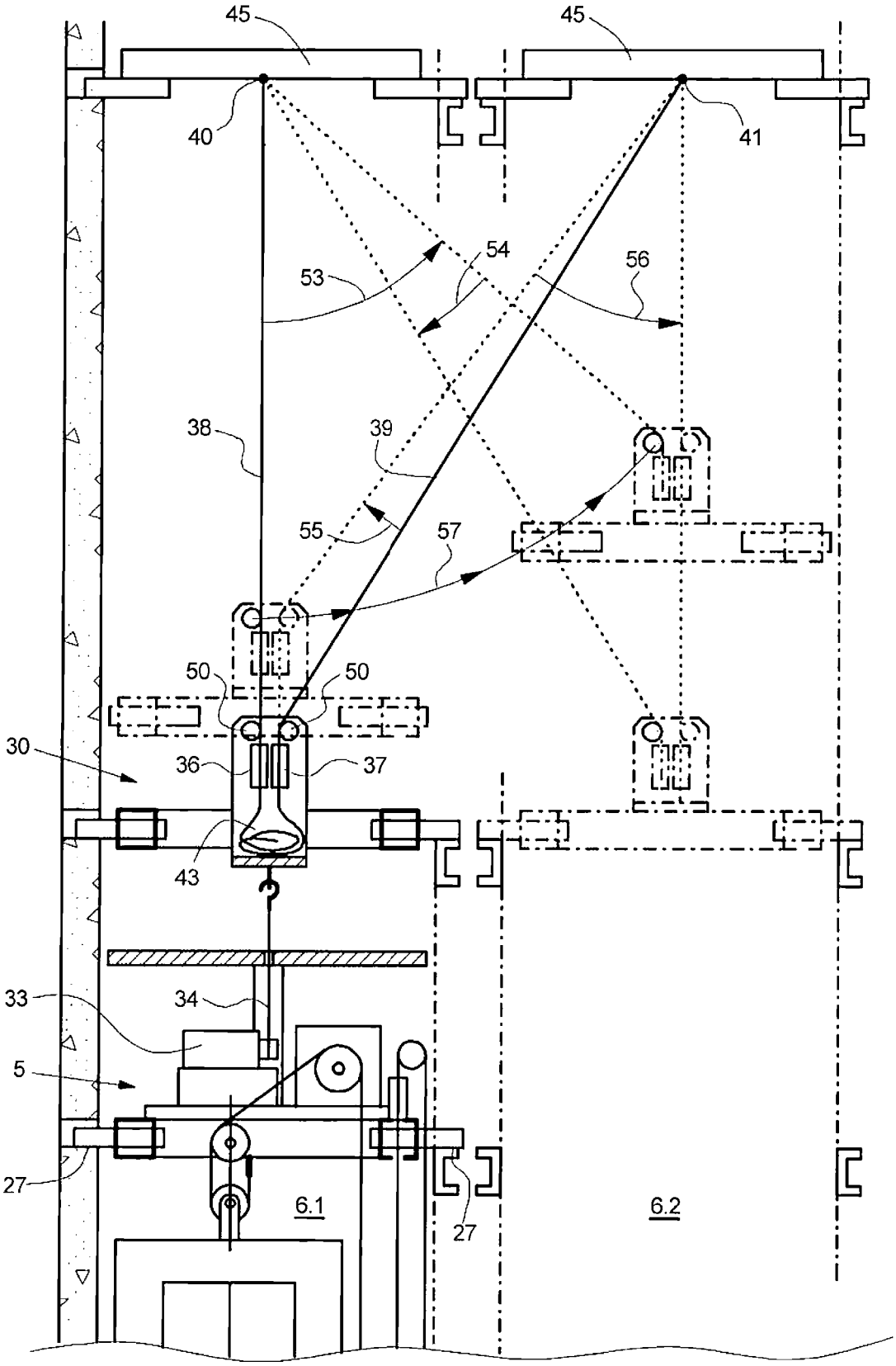
FIG. 2 essentially shows an enlarged section of the depiction of the elevator system according to FIG. 1, with a different arrangement of the drive platform hoist and with a first embodiment of the method for transferring the lifting platform from an elevator shaft delivering the lifting platform to an elevator shaft receiving the lifting platform.

FIG. 2 essentially shows an enlarged section of the elevator system according to FIG. 1. In contrast to FIG. 1, the lifting platform 30 in FIG. 2 has no drive platform hoist, but a drive platform hoist 33 with associated drive platform traction means 34 is mounted on each of the drive platforms 5 for raising all the drive platforms 5, wherein, for performing a lifting operation, the drive platform traction means 34 of the drive platform hoist 33 of the drive platform 5 to be lifted is coupled to the lifting platform 30 positioned above said drive platform.

FIG. 2 is primarily meant to illustrate the operation of a first embodiment of the method for transferring the lifting platform 30 from one of the elevator shafts 6.1, 6.2, (6.3) to another elevator shaft. Two wire rope hoists—in the following called first and second lifting platform hoist 36, 37—are fastened to the lifting platform 30. The first lifting platform hoist 36 interacts with a first lifting platform traction means 38, and the second lifting platform hoist 37 interacts with a second lifting platform traction means 39 in order to be able to raise and move the lifting platform sideways by a coordinated actuation of the lifting platform hoists. The lifting platform hoists 36, 37 are preferably driven by electric motors. Below the lifting platform hoists 36, 37, a collecting container 43 is attached to the lifting platform 30. In said collecting container, the loose sections of the lifting platform traction means 38, 39 are collected, which are ejected from the lifting platform hoists when the supporting sections of the lifting platform traction means are retracted into the lifting platform hoists 36, 37.

The first lifting platform traction means 38 is guided from the first lifting platform hoist 36 to a first suspension point 40 and fastened there. This first suspension point 40 is supported above the starting position of the lifting platform 30 in the region of the cross-sectional center of the elevator shaft delivering the lifting platform by said elevator shaft. The second lifting platform traction means 39 is guided from the second lifting platform hoist 37 to a second suspension point 41 and also fastened there. This second suspension point 41 is supported at approximately the same height as the first suspension point 40 above the lifting platform 30 in the region of the cross-sectional center of the elevator shaft receiving the lifting platform 30 by said elevator shaft. Above each of the two lifting platform hoists 36, 37, a deflecting body 50 is mounted on the lifting platform 30. These deflecting bodies 50 preferably designed as rollers have the task of guiding the lifting platform traction means 38, 39, which are deflected during the transfer of the lifting platform in variable directions to the respective suspension point, in the correct direction to the lifting platform hoists. As a support for the suspension points 40, 41, at least one vertically moveable support structure forming a protective platform 45 is used, which is temporarily installed and supported in the region of the upper ends of the at least two elevator shafts 6.1, 6.2, which are shifted upwards during the construction phase. Such a protective platform 45 must be present anyway to protect the installation personnel from falling objects.

In order to transfer the lifting platform 30 from the elevator shaft 6.1 delivering the lifting platform to the elevator shaft 6.2 receiving the lifting platform, the lifting platform 30, in a first step, is lifted off its support points 27 by retracting the first lifting platform traction means 38 into the first lifting platform hoist 36. In a second step, the lifting platform is pivoted about the first suspension point 40 as a pivot center approximately into the cross-sectional center of the elevator shaft 6.2 receiving the lifting platform 30 by retracting the second lifting platform traction means 39 into the second lifting platform hoist 37, and in a third step, the lifting platform is moved to its intended vertical position in the elevator shaft 6.2 receiving the lifting platform by retracting or extending at least the second lifting platform traction means into or from the second lifting platform hoist. The arrow 53 marks the angle, by which the first lifting platform traction means 38 is pivoted, and the arrow 56 marks the angle, by which the second lifting platform traction means 39 is pivoted in the course of the sideways movement which forms part of the transfer. The arrows 57 mark the path of the lifting platform 30 during its sideways movement. The arrow 55 marks the angle, by which the second lifting platform traction means 39 is pivoted as a result of the raising of the lifting platform in the first step, and the arrow 54 marks the angle, by which the first lifting platform traction means 38 is pivoted as a result of the depicted lowering of the lifting platform in the third step.

After the lifting platform is supported and secured in the elevator shaft 6.2 receiving said lifting platform, it can be used to raise the drive platform—currently still positioned at a lower level and therefore not visible in FIG. 2—in said elevator shaft 6.2. Such a transfer of the lifting platform 30 can take place before or after raising the lifting platform to a new, higher building level. By repeating the described transfer, the lifting platform 30 can also be moved between elevator shafts 6.1, 6.2, 6.3, between which at least one further elevator shaft is arranged.

Figure 3:
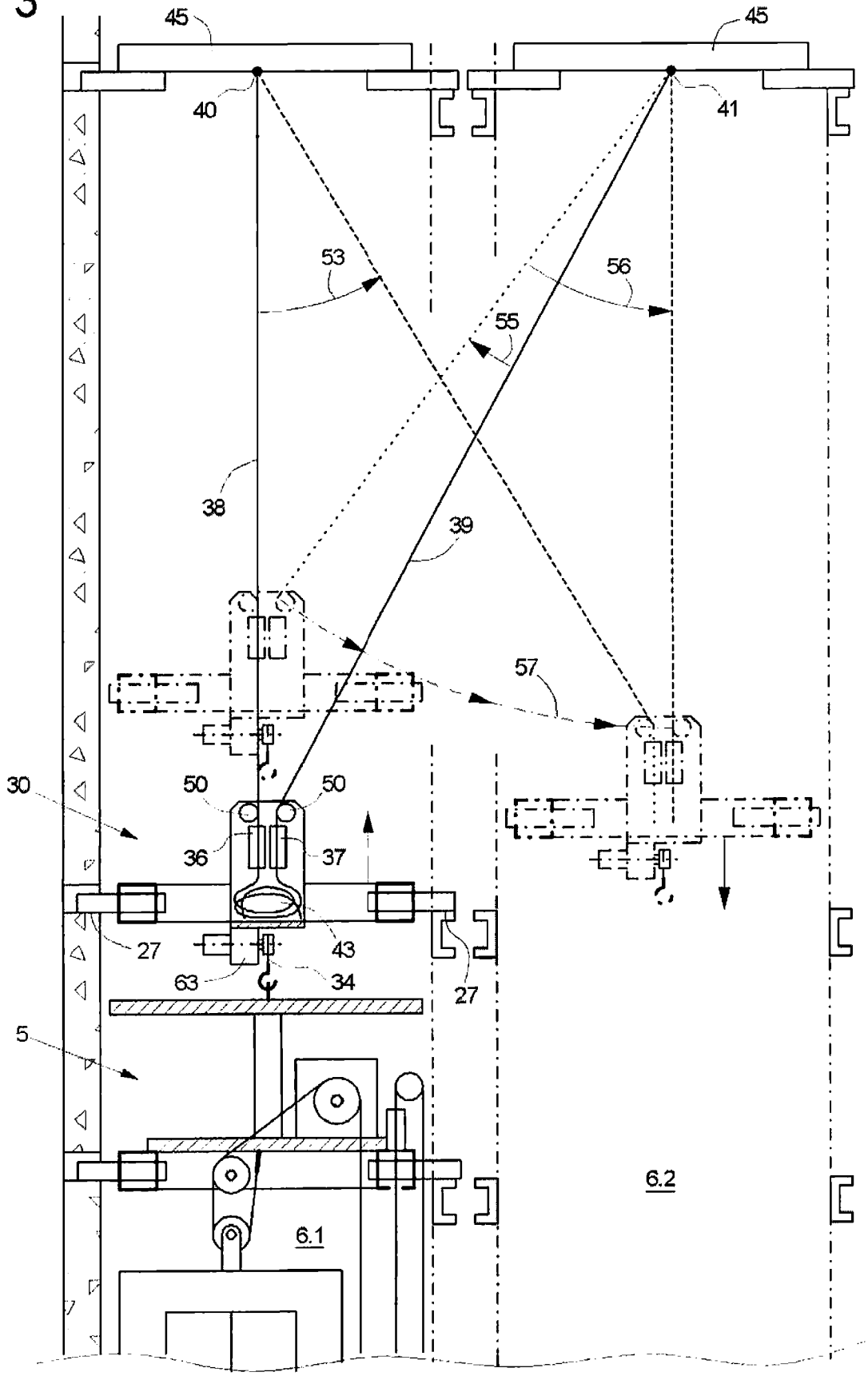
FIGS. 3-6 essentially show enlarged sections of the depiction of the elevator system according to FIG. 1, each with a further embodiment of the method for transferring the lifting platform.

FIG. 3 essentially also shows an enlarged section of the elevator system according to FIG. 1. It is primarily meant to illustrate the operation of a further embodiment of the method for transferring the lifting platform 30 from one of the elevator shafts 6.1, 6.2, (6.3) to another elevator shaft. In contrast to the depiction in FIG. 2, a drive platform hoist 63 with associated drive platform traction means 34 is in this case mounted on the lifting platform 30 and is used to raise the drive platforms 5 of at least two elevators to a higher level. In order to raise one of the drive platforms 5, the lifting platform 30 is positioned and supported above the drive platform 5 to be lifted in the associated elevator shaft, after which the drive platform traction means 34 of the drive platform hoist 63 mounted on the lifting platform 30 is coupled to the drive platform 5 to be lifted.

In the embodiment according to FIG. 3, two wire rope hoists, preferably driven by electric motors and called first and second lifting platform hoist 36, 37, are also fastened to the lifting platform 30. The first lifting platform hoist 36 interacts with a first lifting platform traction means 38, and the second lifting platform hoist 37 interacts with a second lifting platform traction means 39 in order to be able to raise and move the lifting platform sideways by a coordinated actuation of the lifting platform hoists. Below the lifting platform hoists 36, 37, a collecting container 43 is also attached to the lifting platform 30 in the present embodiment. In said collecting container, the loose sections of the lifting platform traction means 38, 39 are collected, which are ejected from the lifting platform hoists when the supporting sections of the lifting platform traction means are retracted into the lifting platform hoists 36, 37.

The first lifting platform traction means 38 is guided from the first lifting platform hoist 36 to a first suspension point 40 and fastened there, wherein said first suspension point 40 is supported above the starting position of the lifting platform 30 in the region of the cross-sectional center of the elevator shaft delivering the lifting platform by said elevator shaft. The second lifting platform traction means 39 is guided from the second lifting platform hoist 37 to a second suspension point 41 and also fastened there, wherein said second suspension point 41 is supported at approximately the same height as the first suspension point 40 above the lifting platform 30 in the region of the cross-sectional center of the elevator shaft receiving the lifting platform 30 by said elevator shaft. In the embodiment described here, there is also a deflecting body 50, preferably designed as a roller, mounted on the lifting platform 30 above each of the two lifting platform hoists 36, 37. These deflecting bodies 50 have the task of guiding the lifting platform traction means 38, 39, which are deflected during the transfer of the lifting platform in variable directions to the respective suspension point, in the correct direction to the lifting platform hoists. As a support for the suspension points 40, 41, once again at least one protective platform 45 designed as a vertically moveable support structure is preferably used. Said protective platform, which is also stringently required for protecting the installation personnel from falling objects, is preferably temporarily installed and supported in the area of the upper ends of the at least two elevator shafts 6.1, 6.2, which move upwards during the construction phase.

In order to transfer the lifting platform 30 from the elevator shaft 6.1 delivering the lifting platform to the elevator shaft 6.2 receiving the lifting platform, the lifting platform 30, in a first step, is lifted off its support points 27 by retracting the first lifting platform traction means 38 into the first lifting platform hoist 36. During or after this, the second lifting platform traction means 39 is essentially kept taut or is tightened by retracting into the second lifting platform hoist 37. In a second step, the lifting platform 30 is pivoted about the pivot center formed by the second suspension point 41 approximately into the cross-sectional center of the elevator shaft 6.2 receiving the lifting platform 30 by extending the first lifting platform traction means 38 from the first lifting platform hoist 36. In a third step, the lifting platform 30 is moved to its intended vertical position in the elevator shaft 6.2 receiving the lifting platform by retracting or extending at least the second lifting platform traction means 39 into or from the second lifting platform hoist 37. In FIG. 3, the arrow 53 once again marks the angle, by which the first lifting platform traction means 38 is pivoted, and the arrow 56 marks the angle, by which the second lifting platform traction means 39 is pivoted in the course of the sideways movement of the lifting platform 30, which forms part of the transfer. The arrows 57 once again mark the path traveled by the lifting platform 30 during its sideways movement according to the embodiment of the method described here. The arrow 55 marks the angle, by which the second lifting platform traction means 39 is pivoted as a result of the raising of the lifting platform in the first step.

After the lifting platform 30 is supported and secured in the elevator shaft 6.2 receiving said lifting platform, it can be used to raise the drive platform—currently still positioned at a lower level and therefore not visible in FIG. 3—in said elevator shaft 6.2. In this embodiment of the method, a transfer of the lifting platform 30 can also take place before or after raising the lifting platform to a new, higher building level. By repeating the described transfer, the lifting platform 30 can also be moved between elevator shafts 6.1, 6.2, 6.3, between which at least one further elevator shaft is arranged.

Figure 4:
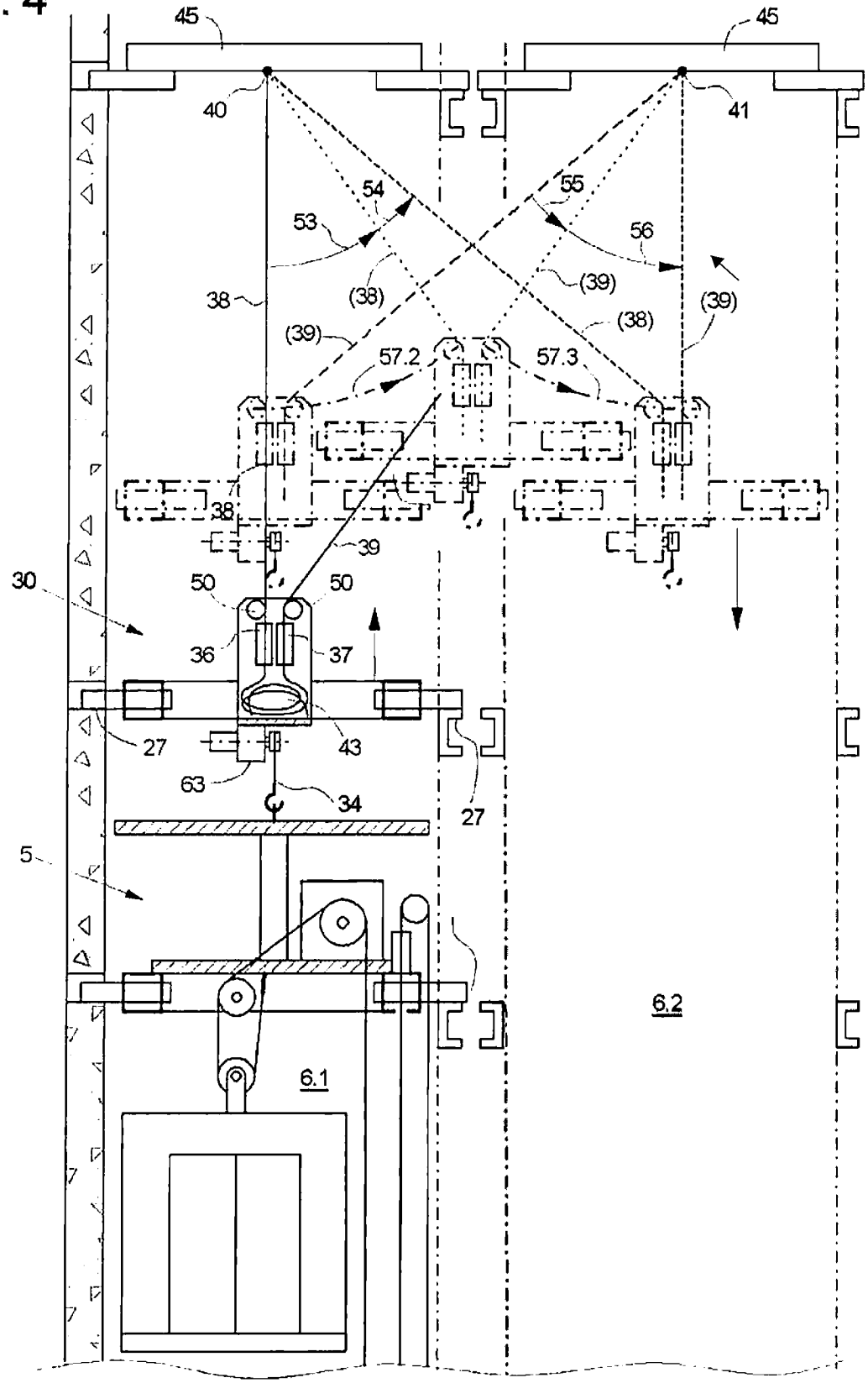

FIG. 4 essentially also shows an enlarged section of the elevator system according to FIG. 1. It is primarily meant to illustrate the operation of a further embodiment of the method for transferring the lifting platform 30 from one of the elevator shafts 6.1, 6.2, (6.3) to another elevator shaft. In the embodiment described in FIG. 4, a drive platform hoist 63 with associated drive platform traction means 34 is once again mounted on the lifting platform 30, said drive platform hoist 63 being used to raise one of the drive platforms 5 of the at least two elevators to a higher level adapted to the current building height. In order to raise one of the drive platforms 5, the lifting platform 30 is positioned and supported above the drive platform 5 to be lifted in the associated elevator shaft, after which the drive platform traction means 34 of the drive platform hoist 63 mounted on the lifting platform 30 is coupled to the drive platform 5 to be lifted.

In the embodiment according to FIG. 4, two wire rope hoists, preferably driven by electric motors and called first and second lifting platform hoist 36, 37, are also fastened to the lifting platform 30. The first lifting platform hoist 36 interacts with a first lifting platform traction means 38, and the second lifting platform hoist 37 interacts with a second lifting platform traction means 39 in order to be able to raise and move the lifting platform sideways by a coordinated actuation of the lifting platform hoists. Below the lifting platform hoists 36, 37, a collecting container 43 is also attached to the lifting platform 30 in the present embodiment. In said collecting container, the loose sections of the lifting platform traction means 38, 39 are collected, which are ejected from the lifting platform hoists when the supporting sections of the lifting platform traction means are retracted into the lifting platform hoists 36, 37.

In the present embodiment, the first lifting platform traction means 38 is also guided from the first lifting platform hoist 36 to a first suspension point 40 and fastened there, wherein said first suspension point 40 is supported above the starting position of the lifting platform 30 in the region of the cross-sectional center of the elevator shaft delivering the lifting platform by said elevator shaft. The second lifting platform traction means 39 is guided from the second lifting platform hoist 37 to a second suspension point 41 and also fastened there (the depiction of the second lifting platform traction means 39 in the starting position of the lifting platform 30 is interrupted because it would cover up the depiction of the lifting platform traction means in a subsequent position of the lifting platform). The second suspension point 41 is supported at approximately the same height as the first suspension point 40 above the lifting platform 30 in the region of the cross-sectional center of the elevator shaft receiving the lifting platform 30 by said elevator shaft. A deflecting body 50, preferably designed as a roller, is mounted on the lifting platform 30 above each of the two lifting platform hoists 36, 37. These deflecting bodies 50 have the task of guiding the lifting platform traction means 38, 39, which are deflected during the transfer of the lifting platform in variable directions to the respective suspension point, in the correct direction to the lifting platform hoists. As a support for the suspension points 40, 41, once again at least one protective platform 45 designed as a vertically moveable support structure is preferably used. Said protective platform, which is also stringently required for protecting the installation personnel from falling objects, is preferably temporarily installed and supported in the area of the upper ends of the at least two elevator shafts 6.1, 6.2, which move upwards during the construction phase.

In order to transfer the lifting platform 30 from the elevator shaft 6.1 delivering the lifting platform to the elevator shaft 6.2 receiving the lifting platform, the lifting platform 30, in a first step, is lifted vertically off its support points 27 by retracting the first lifting platform traction means 38 into the first lifting platform hoist 36. In a second step, the lifting platform 30 is pivoted about the first suspension point 40 as a pivot center approximately to the middle between said elevator shafts by retracting the second lifting platform traction means 39 into the second lifting platform hoist 37. In a third step, the lifting platform 30 is pivoted about the second suspension point 41 as a pivot center approximately into the cross-sectional center of the elevator shaft receiving the lifting platform by extending the first lifting platform traction means 38 from the first lifting platform hoist 36, and in a fourth step, the lifting platform is moved in the vertical direction to its intended vertical position in the elevator shaft receiving the lifting platform by retracting or extending at least the second lifting platform traction means 39 into or from the second lifting platform hoist 37. The arrow 53 marks the angle, by which the first lifting platform traction means 38 is pivoted in the course of the second step, and the arrow 55 marks the angle, by which the second lifting platform traction means 39 is pivoted in the course of the second step. The arrow 54 marks the angle, by which the first lifting platform traction means 38 is pivoted in the course of the third step, and the arrow 56 marks the angle, by which the second lifting platform traction means 39 is pivoted in the course of the third step. The arrow 57.2 here marks the path traveled by the lifting platform 30 during the second step, and the arrow 57.3 marks the path traveled by the lifting platform during the third step.

After the lifting platform 30 is supported and secured in the elevator shaft 6.2 receiving said lifting platform, it can be used to raise the drive platform—currently still positioned at a lower level and therefore not visible in FIG. 4—in said elevator shaft 6.2. In this embodiment of the method, a transfer of the lifting platform 30 can also take place before or after raising the lifting platform to a new, higher building level, and by repeating the described transfer, the lifting platform 30 can also be moved between elevator shafts 6.1, 6.2, 6.3, between which at least one further elevator shaft is arranged.

From FIG. 4, it will be readily apparent to a person skilled in the art that an approximately straight-line sideways movement of the lifting platform 30 can be achieved in that the second and third steps of the transfer described above are divided into smaller substeps. This can be affected by alternately actuating the two lifting platform hoists 36, 37 several times during the sideways movement of the lifting platform.

Figure 5:
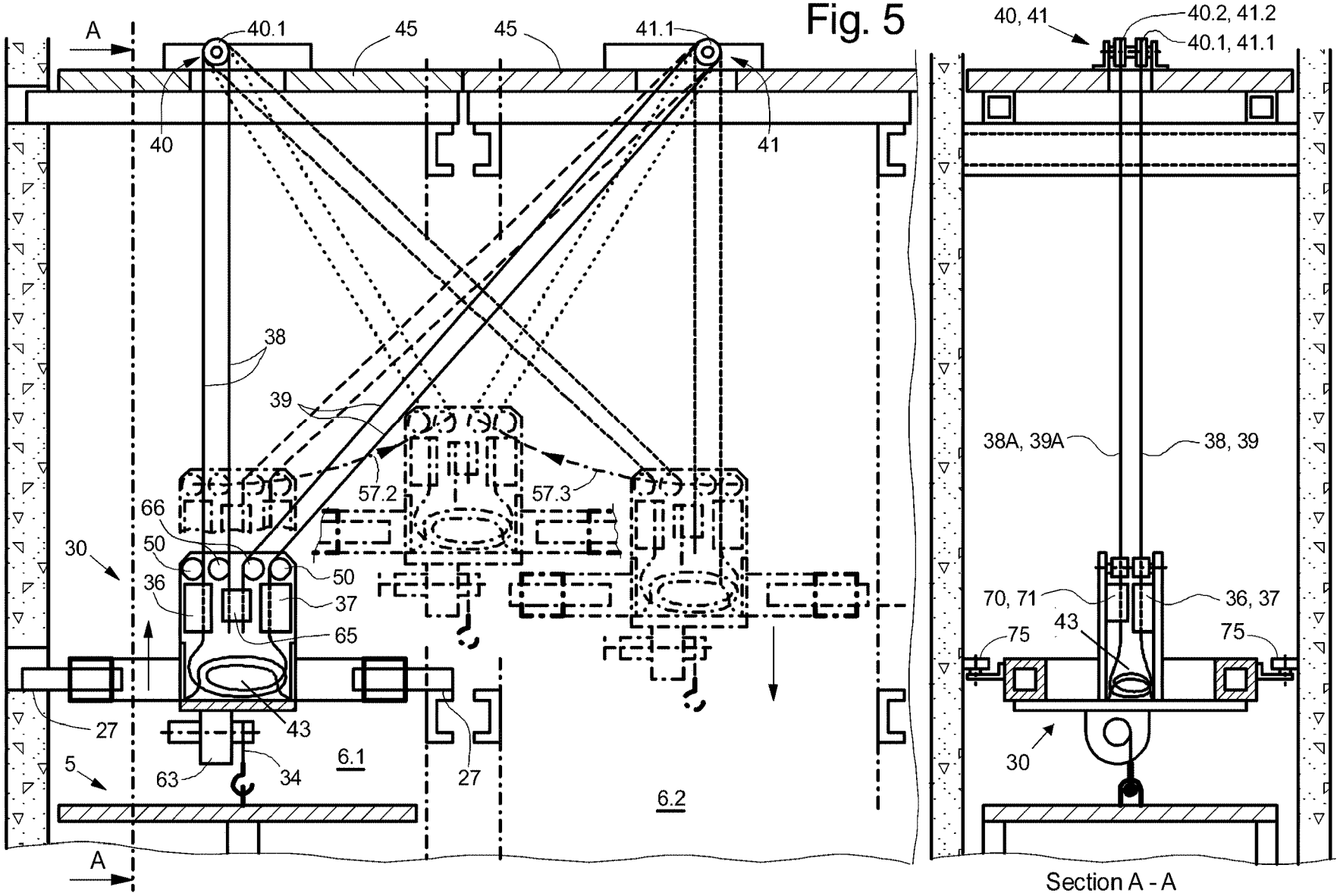

FIG. 5 essentially also shows an enlarged section of the elevator system according to FIG. 1. It is primarily meant to illustrate the operation of a further embodiment of the method for transferring the lifting platform 30 from one of the elevator shafts 6.1, 6.2, (6.3) to another elevator shaft. As in the embodiments according to FIGS. 3 and 4, a drive platform hoist 63 with associated drive platform traction means 34 is once again mounted in this embodiment on the lifting platform 30, said drive platform hoist 63 being used to raise one of the drive platforms 5 of the at least two elevators to a higher level adapted to the current building height. In order to raise one of the drive platforms 5, the lifting platform 30 is positioned and supported above the drive platform 5 to be lifted in the associated elevator shaft, after which the drive platform traction means 34 of the drive platform hoist 63 mounted on the lifting platform 30 is coupled to the drive platform 5 to be lifted.

In the embodiment according to FIG. 5, two wire rope hoists, preferably driven by electric motors and called first and second lifting platform hoist 36, 37, are also fastened to the lifting platform 30. The first lifting platform hoist 36 interacts with a first lifting platform traction means 38, and the second lifting platform hoist 37 interacts with a second lifting platform traction means 39 in order to be able to raise and move the lifting platform sideways by a coordinated actuation of the lifting platform hoists. In contrast to the embodiments described above, each of the two lifting platform traction means 38, 39 is in this case double-guided, i.e., each of the two lifting platform traction means forms a so-called 2:1 traction system. Furthermore, in the present embodiment, securing traction means 38A and 39A are arranged, which essentially extend parallel to each of the two lifting platform traction means 38, 39. Details of these features as well as their effects and advantages shall be described in the following sections of this description.

Below the lifting platform hoists 36, 37, a collecting container 43 is also attached to the lifting platform 30 in the present embodiment. In said collecting container, the loose sections of the lifting platform traction means 38, 39 are collected, which are ejected from the lifting platform hoists when the supporting sections of the lifting platform traction means are retracted into the lifting platform hoists 36, 37. In the sectional view A-A of FIG. 5, shock-absorbing elements 75 can be seen which are mounted on the side of the lifting platform 30 and which are suitable for guiding the lifting platform between shaft walls during the transfer, or which, in the event of any collision of the lifting platform with walls or other components of the elevator shafts, are supposed to prevent damage. In all embodiments of the method, such shock-absorbing elements 75 can preferably be attached to all four sides of the lifting platform 30 and preferably be designed as elastic rollers or as elastic buffers.

In the embodiment according to FIG. 5, the first lifting platform traction means 38 is guided from the first lifting platform hoist 36 to a lifting platform traction means deflection roller 40.1, which forms a first suspension point 40, and then back to a fastening device 65 arranged on the lifting platform in the region of the two lifting platform hoists and fastened there. Said first suspension point 40 is supported above the starting position of the lifting platform 30 in the region of the cross-sectional center of the elevator shaft delivering the lifting platform by said elevator shaft 6.1. The second lifting platform traction means 39 is guided from the second lifting platform hoist 37 to a lifting platform traction means deflection roller 41.1, which forms a second suspension point 41, and then back to the aforementioned fastening device 65 and also fastened there. The second suspension point 41 is supported at approximately the same height as the first suspension point 40 above the lifting platform 30 in the region of the cross-sectional center of the elevator shaft 6.2 receiving the lifting platform 30 by said elevator shaft. A deflecting body 50, preferably designed as a roller, is in the present embodiment also mounted on the lifting platform 30 above the two lifting platform hoists 36, 37. These deflecting bodies 50 have the task of guiding the lifting platform traction means 38, 39, which are deflected during the transfer of the lifting platform in variable directions to the respective suspension point, in the correct direction to the lifting platform hoists. Also shown here are deflection bodies 66 for deflecting the sections of the lifting platform traction means 38, 39 guided to the fastening device 65. As a support for the lifting platform traction means deflection rollers 40.1, 41.1 forming the suspension points 40, 41, once again at least one protective platform 45 designed as a vertically moveable support structure is preferably used. Said protective platform, which is also stringently required for protecting the installation personnel from falling objects, is preferably temporarily installed and supported in the area of the upper ends of the at least two elevator shafts 6.1, 6.2, which move upwards during the construction phase.

The process of transferring the lifting platform 30 from the elevator shaft 6.1 and delivering the lifting platform to the elevator shaft 6.2 receiving the lifting platform essentially corresponds to the process described in connection with FIG. 4. In a first step, the lifting platform 30 is lifted vertically off its support points 27 by retracting the first lifting platform traction means 38 into the first lifting platform hoist 36. In a second step, the lifting platform 30 is pivoted about the first suspension point 40 as a pivot center approximately to the middle between said elevator shafts by retracting the second lifting platform traction means 39 into the second lifting platform hoist 37. In a third step, the lifting platform 30 is pivoted about the second suspension point 41 as a pivot center approximately into the cross-sectional center of the elevator shaft receiving the lifting platform by extending the first lifting platform traction means 38 from the first lifting platform hoist 36, and in a fourth step, the lifting platform is moved in the vertical direction to its intended vertical position in the elevator shaft receiving the lifting platform by retracting or extending at least the second lifting platform traction means 39 into or from the second lifting platform hoist 37. The arrow 57.2 here marks the path traveled by the lifting platform 30 during the second step, and the arrow 57.3 marks the path traveled by the lifting platform during the third step.

In an embodiment with double-guided lifting platform traction means and/or with securing traction means, the transfer or the sideways movement can naturally also be performed in the manner shown in FIGS. 2 and 3.

After the lifting platform 30 is supported and secured in the elevator shaft 6.2 receiving said lifting platform, it can be used to raise the drive platform—currently still positioned at a lower level and therefore not visible in FIG. 5—in said elevator shaft 6.2. In this embodiment of the method, a transfer of the lifting platform 30 can also take place before or after raising the lifting platform to a new, higher building level, and by repeating the described transfer, the lifting platform 30 can also be moved between elevator shafts 6.1, 6.2, 6.3, between which at least one further elevator shaft is arranged.

An advantage of the method shown in FIG. 5 over the methods described in FIGS. 1-4 is that, due to the double-guided lifting platform traction means (2:1 suspension), the tensile forces in the lifting platform traction means, the required driving forces of the lifting platform hoist, and the holding forces in the fastening devices of the lifting platform traction means are halved.

In the method shown in FIG. 5 for transferring a lifting platform 30 from one of the elevator shafts 6.1, 6.2, (6.3) to another elevator shaft, securing traction means 38A, 39A are present, which are used as fall protection for the lifting platform 30 during its transfer and which are arranged essentially parallel to lifting platform traction means 38, 39. In section A-A of FIG. 5, the outline of the securing traction means 38A, 39A covered up by the lifting platform traction means 38, 39 can be seen. Each of the securing traction means is fastened to the lifting platform 30 and is guided from the lifting platform 30 to a securing traction means deflection roller 40.2, 41.2 fastened in the region of one of the suspension points 40, 41 provided for the lifting platform traction means 38, 39, and subsequently guided back to the lifting platform 30 and through a traction means safety catch 70, 71 attached to the lifting platform. Said traction means safety catch 70, 71 blocks the securing traction means and thus a lowering of the lifting platform 30 when a speed, at which the securing traction means moves through the safety catch, exceeds a specific limit. Therefore, a further advantage of the method shown in FIG. 5 over the method described in FIGS. 1-4 is that the risk of personal injury and material damage during the transfer of the lifting platform is significantly reduced with the described fall protection. The load on the securing traction means and the traction means safety catch possibly occurring due to a required use of the fall protection is advantageously halved thanks to the guiding of the securing traction means over a securing traction means deflection roller (2:1 suspension).

Figure 6:
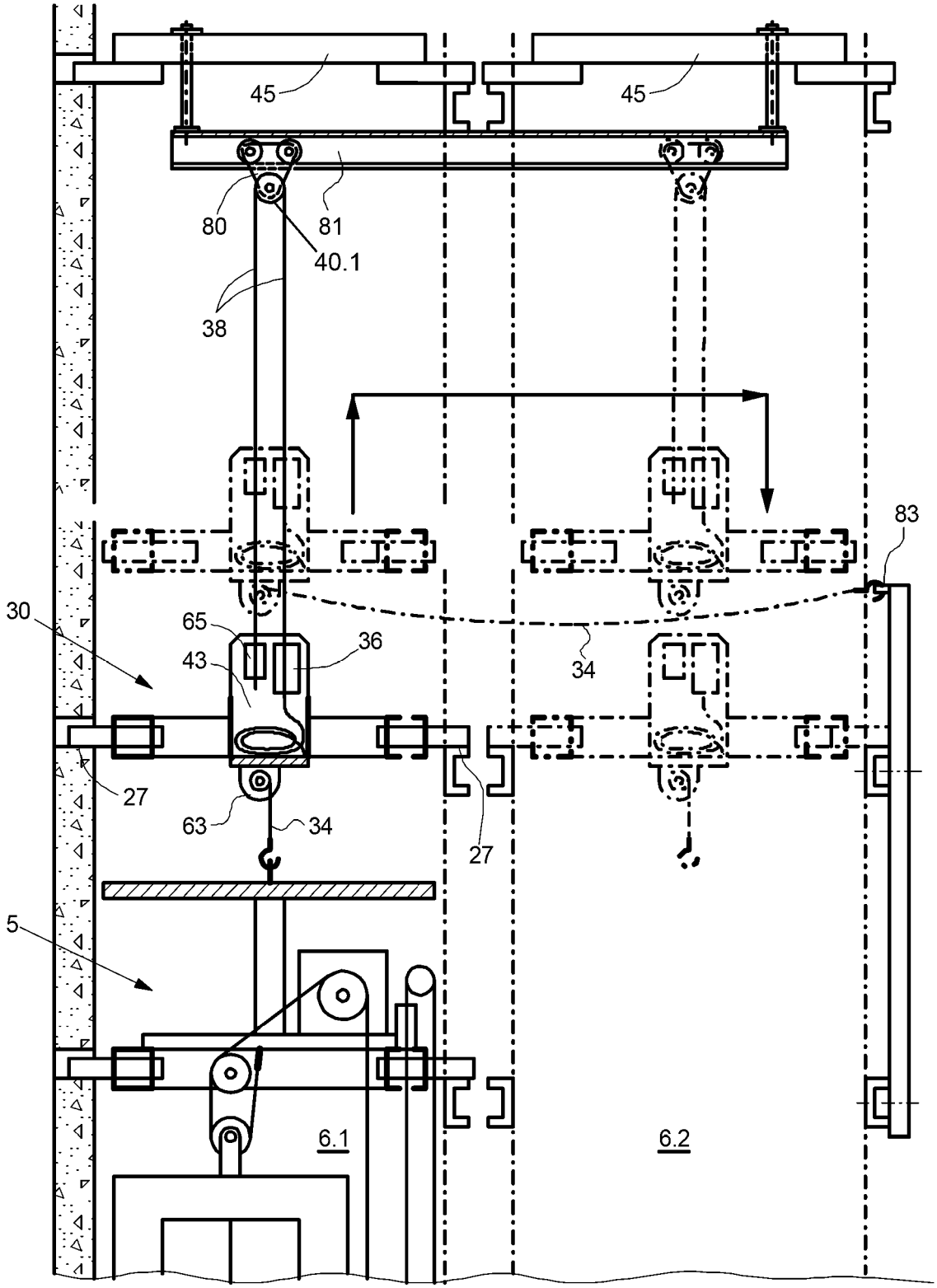

FIG. 6 essentially also shows an enlarged section of the elevator system according to FIG. 1. It is primarily meant to illustrate the operation of a further embodiment of the method for transferring the lifting platform 30 from one of the elevator shafts 6.1, 6.2, (6.3) to another elevator shaft. As in the embodiments according to FIGS. 3 to 5, a drive platform hoist 63 with associated drive platform traction means 34 is in this embodiment once again mounted on the lifting platform 30, said drive platform hoist 63 being used to raise one of the drive platforms 5 of the at least two elevators to a higher level adapted to the current building height. In order to raise one of the drive platforms 5, the only lifting platform 30 is positioned and supported above the drive platform 5 to be lifted in the associated elevator shaft, after which the drive platform traction means 34 of the drive platform hoist 63 mounted on the lifting platform 30 is coupled to the drive platform 5 to be lifted.

The embodiment of the method according to FIG. 6 differs from the embodiments according to FIGS. 1-5 in that the sideways movement of the lifting platform 30, which forms part of the transfer, is not achieved by a coordinated actuation of two lifting platform hoists acting on two lifting platform traction means. In this case, the sideways movement is affected by a horizontal movement of a horizontal moving mechanism 80, on which the lifting platform 30 is suspended in a raiseable and lowerable manner. In addition, both the raising of the lifting platform to a higher level adapted to the progress of the building process and the raising and lowering of the lifting platform required to perform a transfer are accomplished by means of a single lifting platform hoist 36 acting on a single lifting platform traction means 38. For the sideways movement during the transfer of the lifting platform from an elevator shaft delivering the lifting platform to an elevator shaft receiving the lifting platform, the horizontal moving mechanism 80 is preferably moved along a horizontal track 81 formed by a steel beam, said horizontal track being mounted temporarily above the transfer platform to be transferred at least between the elevator shaft delivering the lifting platform and the elevator shaft receiving the lifting platform shaft and supported by said elevator shafts. In this embodiment, the horizontal track is supported on the elevator shafts preferably via at least one protective platform 45 which is designed as a support structure that can be moved vertically and supported in the elevator shaft. Said protective platform, which is also used as a protection against falling objects, is preferably temporarily installed in the region of the upper ends of the at least two elevator shafts 6.1, 6.2, which move upwards during the course of the construction phase. In the embodiment according to FIG. 6, the only lifting platform 36, preferably driven by an electric motor, is fastened to the lifting platform 30. However, it could also be mounted on said horizontal moving mechanism. In order to be able to raise the lifting platform, the lifting platform hoist 36 interacts with a lifting platform traction means 38. In the depicted embodiment, the lifting platform traction means 38 is double-guided, i.e., it forms a so-called 2:1 traction system in that it is guided upwardly from the lifting platform hoist to a lifting platform traction means deflection roller 40.1 present on the horizontal moving mechanism and subsequently back to a fastening device 65 arranged on the lifting platform 30 and fastened there. Of course, an embodiment with a lifting platform traction means, which is single-guided or more than double-guided (multiple receiving), can also be realized. In the embodiment according to FIG. 6, it is also possible and expedient to arrange a securing traction means with a traction means safety catch (both not visible in FIG. 6), as already described in connection with the embodiment according to FIG. 5. Such a securing traction means extends essentially parallel to the lifting platform traction means 38 and blocks a lowering of the lifting platform 30 when the speed, at which the securing traction means moves through the traction means safety catch, exceeds a specific limit. In the present embodiment, a collecting container 43 is once again attached below the lifting platform hoist 36 to the lifting platform 30, in which the loose section of the lifting platform traction means 38 are collected, which are ejected from the lifting platform hoist when the supporting section of the lifting platform traction means is retracted into the lifting platform hoist 36.

The drive platform hoist 63 installed on the lifting platform and used for raising the drive platforms, or the lifting platform hoist 36 installed on the lifting platform 30 and used for raising the lifting platform, is preferably used as the drive for the sideways movement of the lifting platform 30 along the horizontal track 81. For such purpose, the traction means 34 of the drive platform hoist or the traction means 38 of the lifting platform hoist 36 is arranged such that it extends essentially horizontally from the respective hoist to a fastening point 83 present in the region of the elevator shaft receiving the lifting platform.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for constructing elevators in a building under construction, wherein a usable lifting height of each of the elevators is adapted to an increasing height of the building, wherein each of the elevators is arranged in an associated elevator shaft of the building and includes a drive platform having an elevator drive machine that supports and drives an elevator car and a counterweight by a traction sheave and at least one flexible suspension means, and wherein, in order to adapt the usable lifting heights, lifting operations are performed in which in alternation the drive platforms of the elevators are each raised to a higher level in the associated elevator shaft and locked there, the method comprising the steps of:

for performing the lifting operations, positioning a single lifting platform alternately above one of the drive platforms of the elevators to be lifted and temporarily fastening the lifting platform in the associated elevator shaft; and applying a lifting force from the lifting platform to the drive platform currently to be lifted, in order to raise the drive platform to the higher level, whereby the lifting force is transferred via the lifting platform to supporting elements of the associated elevator shaft.

2. The method according to claim 1 wherein the lifting platform has installed thereon a drive platform hoist with a drive platform traction means for raising the drive platforms, and including, for performing the lifting operations, coupling the drive platform traction means to the drive platform of the elevator to be lifted.

3. The method according to claim 1 wherein each of the drive platforms has installed thereon a drive platform hoist with a drive platform traction means for raising the drive platform, and including, for performing the lifting operations, coupling the drive platform traction means of the drive platform hoist of the drive platform to be lifted to the lifting platform positioned above the drive platform to be lifted.

4. The method according to claim 1 including transferring the lifting platform between adjacent ones of the associated elevator shafts for alternately raising the drive platforms wherein the lifting platform is suspended on a first lifting platform traction means driven by a first lifting platform hoist and on a second lifting platform traction means driven by a second lifting platform hoist, and performing the transfer of the lifting platform by a coordinated actuation of the first and second lifting platform hoists.

5. The method according to claim 4 including at least one shock-absorbing element formed as an elastic roller or an elastic buffer mounted on at least one side of the lifting platform for guiding the lifting platform between walls of the associated elevator shafts.

6. The method according to claim 4 including the steps of:

guiding the first lifting platform traction means from the first lifting platform hoist and fastening to a first suspension point, wherein the first suspension point is supported above the lifting platform in a region of a cross-sectional center of a first of the adjacent associated elevator shafts; and guiding the second lifting platform traction means from the second lifting platform hoist and fastening to a second suspension point, wherein the second suspension point is supported above the lifting platform in a region of a cross-sectional center of a second of the adjacent associated elevator shafts.

7. The method according to claim 6 wherein the first and second suspension points are arranged on at least one protective platform installed in and supported by a region at upper ends of the adjacent associated elevator shafts, the at least one protective platform being vertically moveable during the construction of the building.

8. The method according to claim 6 including mounting at least one securing traction means in the building to function as fall protection for the lifting platform during the transferring, the at least one securing traction means being fastened to the lifting platform, guided from the lifting platform to a securing traction means deflection roller fastened in a region of one of the first and second suspension points, and guided back to the lifting platform and through a traction means safety catch attached to the lifting platform, the traction means safety catch blocking the at least one securing traction means and thus a lowering of the lifting platform when a speed, at which the at least one securing traction means moves through the traction means safety catch, exceeds a specific limit.

9. The method according to claim 6 wherein prior to performing one of the lifting operations, raising the lifting platform within one of the first and second associated elevator shafts using at least one of the first and second lifting platform hoists with the associated one of the first and second lifting platform traction means.

10. The method according to claim 4 including the steps of:

guiding the first lifting platform traction means from the first lifting platform hoist to wrap around a first lifting platform traction means deflection roller at a first suspension point and back and fastening the first lifting platform traction means to the lifting platform, wherein the first suspension point is supported above the lifting platform in a region of a cross-sectional center of a first elevator shaft of the adjacent associated elevator shafts; and guiding the second lifting platform traction means from the second lifting platform hoist to wrap around a second lifting platform traction means deflection roller at a second suspension point and back and fastening the second lifting platform traction means to the lifting platform, wherein the second suspension point is supported above the lifting platform in a region of a cross-sectional center of a second elevator shaft of the adjacent associated elevator shafts.

11. The method according to claim 10 including the steps of:

raising the lifting platform from support points in the first elevator shaft by retracting the first lifting platform traction means into the first lifting platform hoist;

pivoting the lifting platform about the first suspension point as a pivot center approximately into the cross-sectional center of the second elevator shaft by retracting the second lifting platform traction means into the second lifting platform hoist; and moving the lifting platform to an intended vertical position in the second elevator shaft by retracting or extending the second lifting platform traction means respectively into or from the second lifting platform hoist.

12. The method according to claim 11 including actuating the first and second lifting platform hoists alternately a predetermined number of times during the transfer to affect a straight-line sideways movement of the lifting platform.

13. The method according to claim 10 including the steps of:

raising the lifting platform vertically by retracting the first lifting platform traction means into the first lifting platform hoist, and during or after either keeping the second lifting platform traction means taut or tightening by retracting the second lifting platform means into the second lifting platform hoist;

pivoting the lifting platform about the second suspension point as a pivot center approximately into the cross-sectional center of the second elevator shaft by extending the first lifting platform traction means from the first lifting platform hoist; and moving the lifting platform to an intended vertical position in the second elevator shaft by retracting or extending the second lifting platform traction means respectively into or from the second lifting platform hoist.

14. The method according to claim 13 including actuating the first and second lifting platform hoists alternately a predetermined number of times during the transfer to affect a straight-line sideways movement of the lifting platform.

15. The method according to claim 10 including the steps of:

raising the lifting platform vertically by retracting the first lifting platform traction means into the first lifting platform hoist;

pivoting the lifting platform about the first suspension point as a pivot center approximately to a middle between the first and second elevator shafts by retracting the second lifting platform traction means into the second lifting platform hoist;

pivoting the lifting platform about the second suspension point as a pivot center approximately into the cross-sectional center of the second elevator shaft by extending the first lifting platform traction means from the first lifting platform hoist; and moving the lifting platform to an intended vertical position in the second elevator shaft by retracting or extending the second lifting platform traction means respectively into or from the second lifting platform hoist.

16. The method according to claim 15 including actuating the first and second lifting platform hoists alternately a predetermined number of times during the transfer to affect a straight-line sideways movement of the lifting platform.

17. The method according to claim 1 including, for the alternate raising of the drive platforms, transferring the lifting platform between adjacent ones of the associated elevator shafts by moving the lifting platform along a horizontal track temporarily installed in the building for the transfer.

18. The method according to claim 17 including using a drive platform hoist installed on the lifting platform or a lifting platform hoist installed on the lifting platform to drive sideways movement of the lifting platform along the horizontal track.

19. The method according to claim 18 wherein a traction means of the drive platform hoist or the lifting platform hoist extends horizontally from the drive platform hoist or the lifting platform hoist to a fastening point in a region of one of the associated elevator shafts receiving the lifting platform.

* * * * *